US007281379B2

(12) United States Patent
Brasz

(10) Patent No.: US 7,281,379 B2
(45) Date of Patent: Oct. 16, 2007

(54) DUAL-USE RADIAL TURBOMACHINE

(75) Inventor: Joost J. Brasz, Fayetteville, NY (US)

(73) Assignee: UTC Power Corporation, South Windsor, CT (US)

( * ) Notice: Subject to any disclaimer, the term of this patent is extended or adjusted under 35 U.S.C. 154(b) by 579 days.

(21) Appl. No.: 10/293,713

(22) Filed: Nov. 13, 2002

(65) Prior Publication Data

US 2004/0088983 A1 May 13, 2004

(51) Int. Cl.
*F02G 3/00* (2006.01)

(52) U.S. Cl. ..... 60/616; 60/618; 415/203

(58) Field of Classification Search ..... 60/670, 60/614, 616, 618, 597, 651, 671; 415/120, 415/202, 203
See application file for complete search history.

(56) References Cited

U.S. PATENT DOCUMENTS 3,292,364 A * 12/1966 Cazier ..... 417/380
3,393,515 A 7/1968 Tabor et al.
3,830,062 A * 8/1974 Morgan et al. ..... 60/618
4,027,994 A * 6/1977 MacInnes ..... 415/1
4,386,499 A 6/1983 Raviv et al.
4,458,493 A 7/1984 Amir et al.
4,590,384 A 5/1986 Bronicki
4,617,808 A 10/1986 Edwards
4,760,705 A 8/1988 Yogev et al.
4,901,531 A 2/1990 Kubo et al.
5,038,567 A 8/1991 Mortiz
5,119,635 A 6/1992 Harel
5,145,317 A 9/1992 Brasz
5,207,565 A * 5/1993 Roessler ..... 417/407
5,252,027 A 10/1993 Brasz
5,266,002 A 11/1993 Brasz
5,339,632 A 8/1994 McCrabb et al.
5,445,496 A 8/1995 Brasz
5,598,706 A 2/1997 Bronicki et al.
5,632,143 A 5/1997 Fisher et al.
5,640,842 A 6/1997 Bronicki
5,664,419 A 9/1997 Kaplan
5,761,921 A 6/1998 Hori et al.
5,807,071 A 9/1998 Brasz et al.
5,809,782 A 9/1998 Bronicki et al.
5,860,279 A 1/1999 Bronicki et al.
5,895,793 A 4/1999 Kitamura et al.
6,009,711 A 1/2000 Kreiger et al.

(Continued)

FOREIGN PATENT DOCUMENTS

EP 0 050 959 A1 5/1982

(Continued)

OTHER PUBLICATIONS

Honeywell, HFC-245fa, . . . An Ideal Zero-ODP Blowing Agent, no date.

(Continued)

*Primary Examiner*—Hoang Nguyen
(74) *Attorney, Agent, or Firm*—Marjama Muldoon Blasiak & Sullivan LLP

(57) ABSTRACT

The impeller is preferably modified to use back swept, radial or forward swept blades to accommodate relatively low, medium and high lift, respectively applications for both centrifugal compressor and turbine rotor use.

18 Claims, 7 Drawing Sheets

U.S. PATENT DOCUMENTS

| | | | | |
|---|---|---|---|---|
| 6,041,604 | A | 3/2000 | Nicodemus | |
| 6,050,083 | A | 4/2000 | Meckler | |
| 6,101,813 | A | 8/2000 | Sami et al. | |
| 6,233,938 | B1 | 5/2001 | Nicodemus | |
| 6,374,629 | B1 * | 4/2002 | Oberle et al. | 62/473 |
| 6,393,840 | B1 * | 5/2002 | Hay | 60/618 |
| 6,497,090 | B2 | 12/2002 | Bronicki et al. | |
| 6,539,718 | B2 | 4/2003 | Bronicki et al. | |
| 6,539,720 | B2 | 4/2003 | Rouse et al. | |
| 6,539,723 | B2 | 4/2003 | Bronicki et al. | |
| 6,571,548 | B1 | 6/2003 | Bronicki et al. | |
| 6,598,397 | B2 * | 7/2003 | Hanna et al. | 60/651 |
| 2002/0148225 | A1 | 10/2002 | Lewis | |
| 2003/0029169 | A1 | 2/2003 | Hanna et al. | |
| 2003/0089110 | A1 | 5/2003 | Niikura et al. | |
| 2003/0167769 | A1 | 9/2003 | Bharathan et al. | |

FOREIGN PATENT DOCUMENTS

| | | |
|---|---|---|
| EP | 0 050 959 B1 | 5/1982 |
| EP | 0 121 392 | 10/1984 |
| WO | 96/39577 | 12/1996 |

OTHER PUBLICATIONS

Gary J. Zyhowski, Sr., Mark W. Spatz and Samuel Motta, An Overview of the Properties and Applications of HFC-245fa, no date.

Thermodynamics of Waste Heat Recovery in Motor Ships, Professor A.J. Morton, MSc, Manchester University, Mechanical Engineering Dept., Trans I Mar E (C), 1981, vol. 93, Paper C69, pp. 1-7.

* cited by examiner

DUAL-USE RADIAL TURBOMACHINE

BACKGROUND OF THE INVENTION

This invention relates generally to organic rankine cycle systems and, more particularly, to an economical and practical method and apparatus therefor.

The well known closed rankine cycle comprises a boiler or evaporator for the evaporation of a motive fluid, a turbine fed with vapor from the boiler to drive the generator or other load, a condenser for condensing the exhaust vapors from the turbine and a means, such as a pump, for recycling the condensed fluid to the boiler. Such a system as is shown and described in U.S. Pat. No. 3,393,515.

Such rankine cycle systems are commonly used for the purpose of generating electrical power that is provided to a power distribution system, or grid, for residential and commercial use across the country. The motive fluid used in such systems is often water, with the turbine then being driven by steam. The source of heat to the boiler can be of any form of fossil fuel e.g. oil, coal, natural gas or nuclear power. The turbines in such systems are designed to operate at relatively high pressures and high temperatures and are relatively expensive in their manufacture and use.

With the advent of the energy crisis and, the need to conserve, and to more effectively use, our available energies, rankine cycle systems have been used to capture the so called "waste heat", that was otherwise being lost to the atmosphere and, as such, was indirectly detrimental to the environment by requiring more fuel for power production than necessary.

One common source of waste heat can be found at landfills where methane gas is flared off to thereby contribute to global warming. In order to prevent the methane gas from entering the environment and thus contributing to global warming, one approach has been to burn the gas by way of so called "flares". While the combustion products of methane ($CO_2$ and $H_2O$) do less harm to the environment, it is a great waste of energy that might otherwise be used.

Another approach has been to effectively use the methane gas by burning it in diesel engines or in relatively small gas turbines or microturbines, which in turn drive generators, with electrical power then being applied directly to power-using equipment or returned to the grid. With the use of either diesel engines or microturbines, it is necessary to first clean the methane gas by filtering or the like, and with diesel engines, there is necessarily significant maintenance involved. Further, with either of these approaches there is still a great deal of energy that is passed to the atmosphere by way of the exhaust gases.

Other possible sources of waste heat that are presently being discharged to the environment are geothermal sources and heat from other types of engines such as reciprocating engines that give off heat both in their exhaust gases and to cooling water.

To the extent that a rankine cycle system can be used in addressing the problems associated with waste heat, feasibility of their use is dependent on the ability to assemble the various components in a reasonably economical manner. This requirement is further complicated by the fact that the design of the components may necessarily change with different applications. For example, inasmuch as various sources of waste heat are necessarily at substantially different temperatures, a single design of a rankine cycle system for use with all such sources will not necessarily ensure the effective and economical use of those waste heat sources.

It is therefore an object of the present invention to provide a new and improved closed rankine cycle power plant that can more effectively use waste heat.

Another object of the present invention is the provision for a rankine cycle turbine that is economical and effective in manufacture and use.

Yet another object of the present invention is the provision for more effectively using the secondary sources of waste heat.

Yet another object of the present invention is the provision for a rankine cycle system which can operate at relatively low temperatures and pressures.

Still another object of the present invention is the provision for a rankine cycle system which is economical and practical in use.

These objects and other features and advantages become more readily apparent upon reference to the following descriptions when taken in conjunction with the appended drawings.

SUMMARY OF THE INVENTION

Briefly, in accordance with one aspect of the invention, a centrifugal compressor which is designed for compression of refrigerant for purposes of air conditioning, is used in a reverse flow relationship so as to thereby operate as a turbine in a closed organic rankine cycle system. In this way, an existing hardware system which is relatively inexpensive, is used to effectively meet the requirements of an organic rankine cycle turbine for the effective use of waste heat.

By another aspect of the invention, a centrifugal compressor having a vaned diffuser is effectively used as a power generating turbine with flow directing nozzles when used in a reverse flow arrangement.

By yet another aspect of the invention, a centrifugal compressor with a pipe diffuser is used as a turbine when operated in a reverse flow relationship, with the individual pipe openings being used as nozzles.

In accordance with another aspect of the invention, a compressor/turbine uses an organic refrigerant as a motive fluid with the refrigerant being chosen such that its operating pressure is within the operating range of the compressor/turbine when operating as a compressor.

By still another aspect of the invention the design of the impeller for the compressor/turbine is adapted for various applications in such a way as to more effectively use the available energy.

In the drawings as hereinafter described, a preferred embodiment is depicted; however various other modifications and alternate constructions can be made thereto without departing from the true spirt and scope of the invention.

DESCRIPTION OF THE PREFERRED EMBODIMENT

Figure 1:
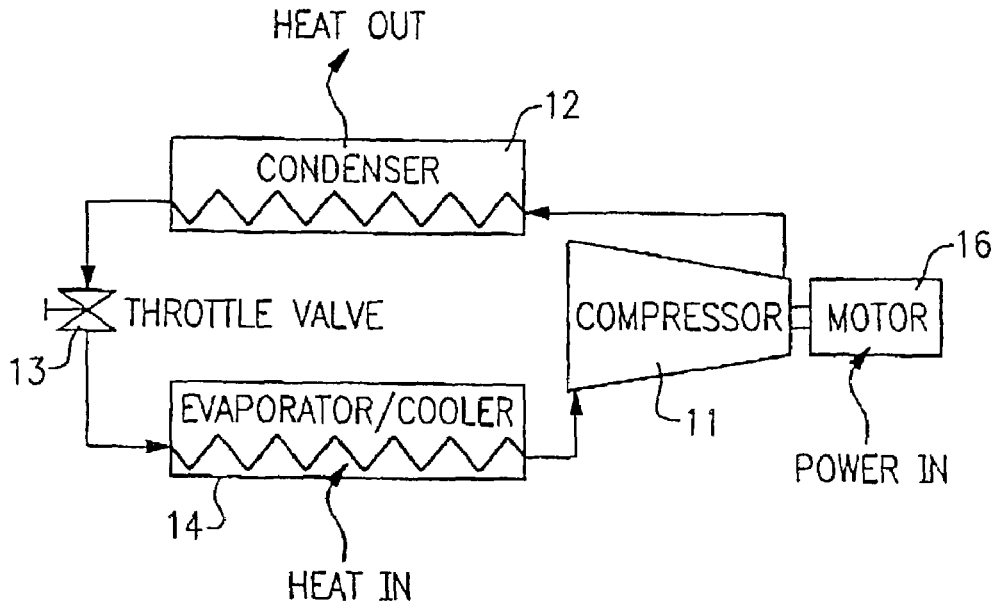
FIG.1 Prior Art
FIG. 1 is a schematic illustration of a vapor compression cycle in accordance with the prior art.

Referring now to FIG. 1, a typical vapor compression cycle is shown as comprising, in serial flow relationship, a compressor 11, a condenser 12, a throttle valve 13, and an evaporator/cooler 14. Within this cycle a refrigerant, such as R-11, R-22, or R-134a is caused to flow through the system in a counterclockwise direction as indicated by the arrows.

The compressor 11 which is driven by a motor 16 receives refrigerant vapor from the evaporator/cooler 14 and compresses it to a higher temperature and pressure, with the relatively hot vapor then passing to the condenser 12 where it is cooled and condensed to a liquid state by a heat exchange relationship with a cooling medium such as air or water. The liquid refrigerant then passes from the condenser to a throttle valve wherein the refrigerant is expanded to a low temperature two-phase liquid/vapor state as it passes to the evaporator/cooler 14. The evaporator liquid provides a cooling effect to air or water passing through the evaporator/cooler. The low pressure vapor then passes to the compressor 11 where the cycle is again commenced.

Depending on the size of the air conditioning system, the compressor may be a rotary, screw or reciprocating compressor for small systems, or a screw compressor or centrifugal compressor for larger systems. A typical centrifugal compressor includes an impeller for accelerating refrigerant vapor to a high velocity, a diffuser for decelerating the refrigerant to a low velocity while converting kinetic energy to pressure energy, and a discharge plenum in the form of a volute or collector to collect the discharge vapor for subsequent flow to a condenser. The drive motor 16 is typically an electric motor which is hermetically sealed in the other end of the compressor 11 and which, through a transmission 26, operates to rotate a high speed shaft.

Figure 2:
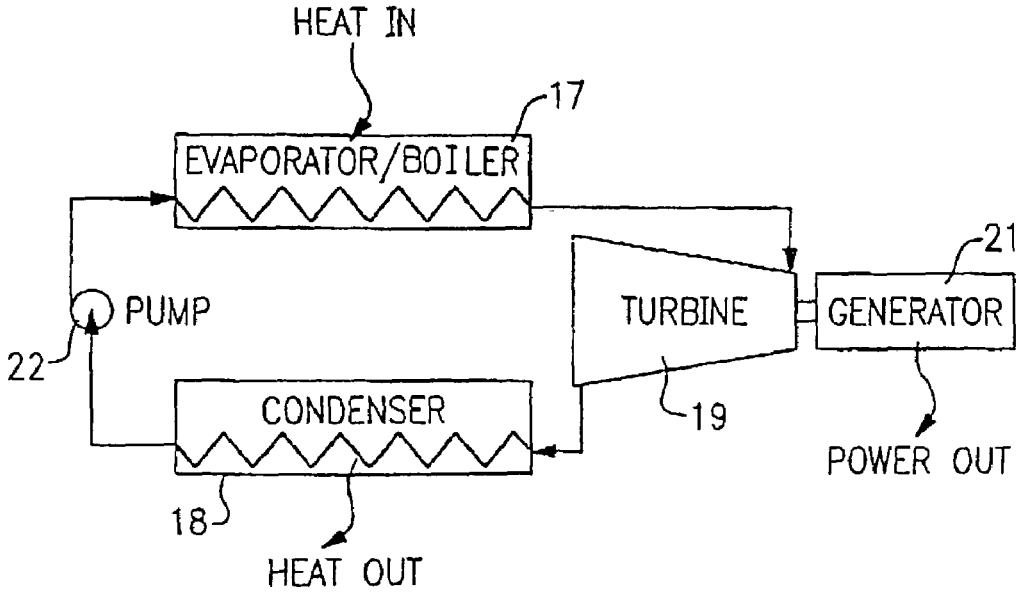
FIG.2 Prior Art
FIG. 2 is a schematic illustration of a rankine cycle system in accordance with the prior art.

A typical rankine cycle system as shown in FIG. 2 also includes an evaporator/cooler 17 and a condenser 18 which, respectively, receives and dispenses heat in the same manner as in the vapor compression cycle as described hereinabove. However, as will be seen, the direction of fluid flow within the system is reversed from that of the vapor compression cycle, and the compressor 11 is replaced with a turbine 19 which, rather then being driven by a motor 16 is driven by the motive fluid in the system and in turn drives a generator 21 that produces power.

In operation, the evaporator which is commonly a boiler having a significant heat input, vaporizes the motive fluid, which is commonly water but may also be a refrigerant, with the vapor then passing to the turbine for providing motive power thereto. Upon leaving the turbine, the low pressure vapor passes to the condenser 18 where it is condensed by way of heat exchange relationship with a cooling medium. The condensed liquid is then circulated to the evaporator/boiler by a pump 22 as shown to complete the cycle.

Figure 3:
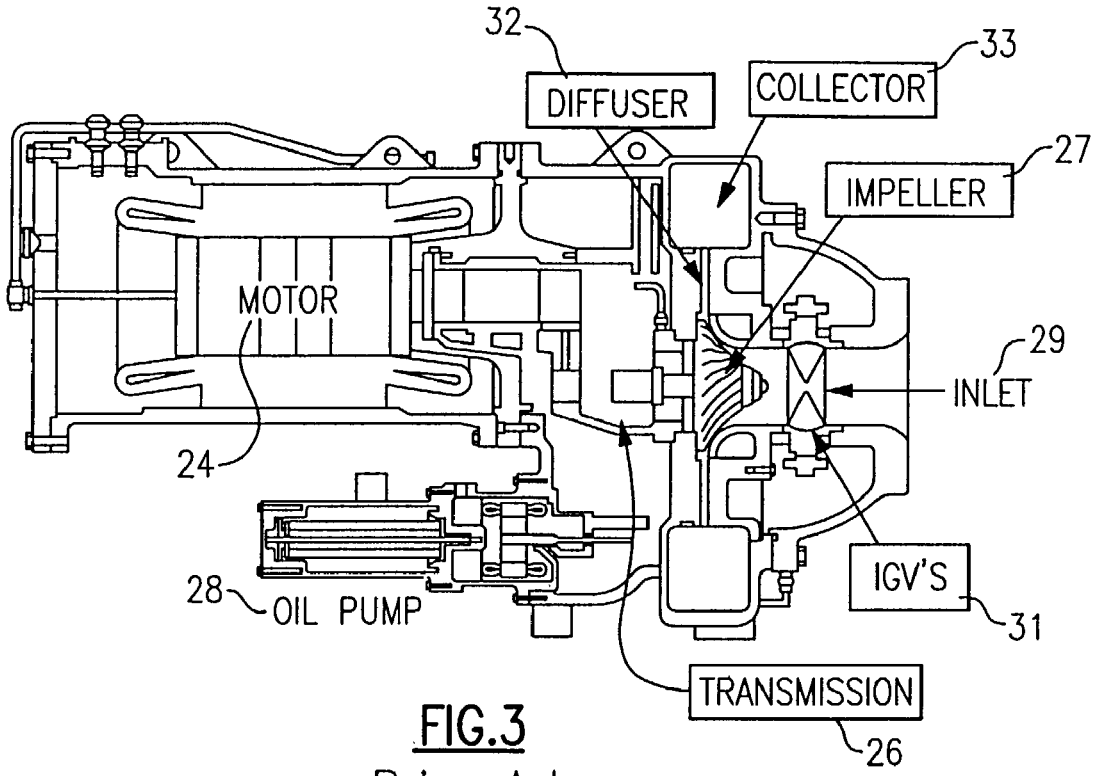
FIG.3 Prior Art
FIG. 3 is a sectional view of a centrifugal compressor in accordance with the prior art.

Referring now to FIG. 3, a typical centrifugal compressor is shown to include an electric drive motor 24 operatively connected to a transmission 26 for driving an impeller 27. An oil pump 28 provides for circulation of oil through the transmission 26. With the high speed rotation of the impeller 27, refrigerant is caused to flow into the inlet 29 through the inlet guide vanes 31, through the impeller 27, through the diffuser 32 and to the collector 33 where the discharge vapor is collected to flow to the condenser as described hereinabove.

Figure 4:
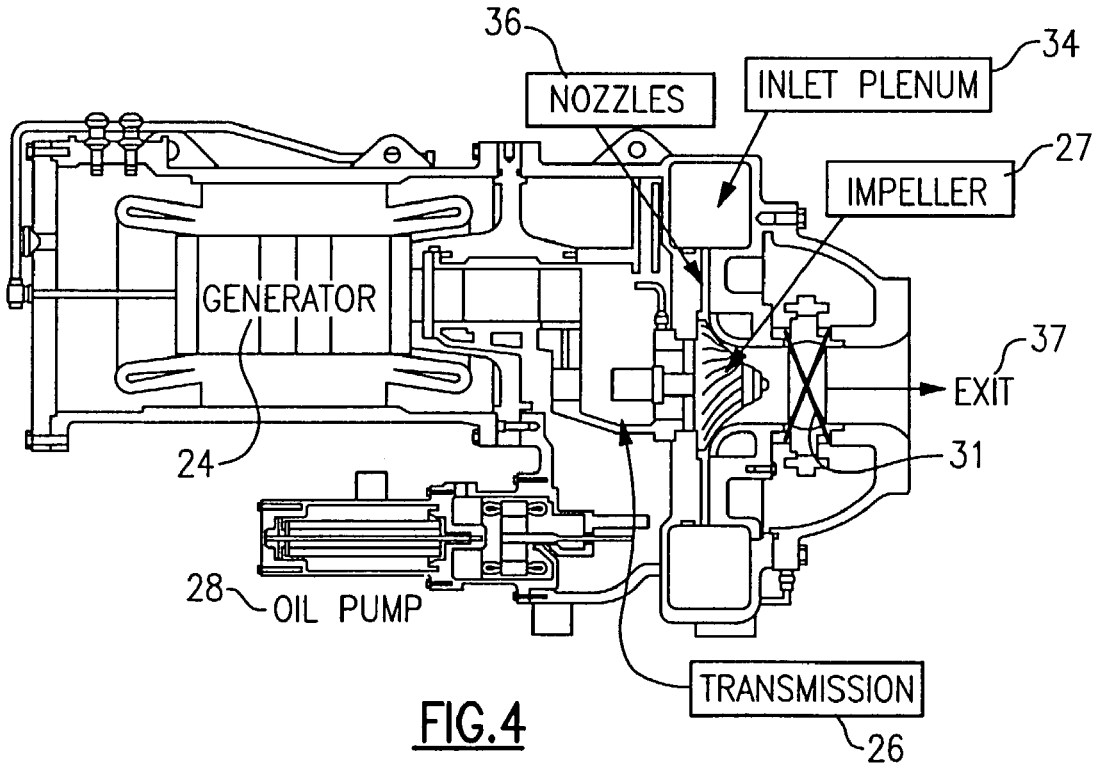
FIG. 4 is a sectional view of a compressor/turbine in accordance with a preferred embodiment of the invention.

In FIG. 4, the same apparatus shown in FIG. 3 is applied to operate as a radial inflow turbine rather then a centrifugal compressor. As such, the motive fluid is introduced into an inlet plenum 34 which had been designed as a collector 33. It then passes radially inwardly through the nozzles 36, which is the same structure which functions as a diffuser in the centrifugal compressor. The motive fluid then strikes the impeller 27 to thereby impart rotational movement thereof. The impeller then acts through the transmission 26 to drive a generator 24, which is the same structure which functioned as a motor in the case of the centrifugal compressor. After passing through the impeller 27 the low pressure gas passes through the inlet guide vanes 31 to an exit opening 37. In this mode of operation, the inlet guide vanes 31 are preferably moved to the fully opened positioned or alternatively, entirely removed from the apparatus.

Figure 5:
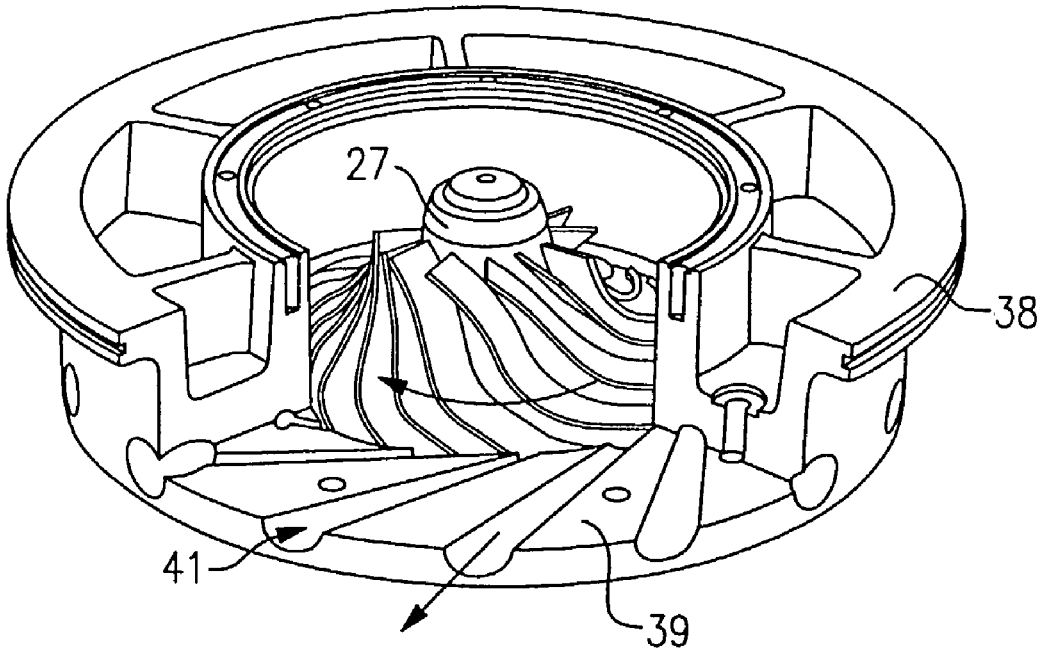
FIG.5 Prior Art
FIG. 5 is a perceptive view of a diffuser structure in accordance with the prior art.

In the centrifugal compressor application as discussed hereinabove the diffuser 32 can be any of the various types, including vaned or vaneless diffusers. One known type of vaned diffuser is known as a pipe diffuser as shown and described in U.S. Pat. No. 5,145,317, assigned to the assignee of the present invention. Such a diffuser is shown at 38 in FIG. 5 as circumferentially surrounding an impeller 27. Here, a backswept impeller 27 rotates in the clockwise direction as shown with the high pressure refrigerant flowing radially outwardly through the diffuser 38 as shown by the arrow. The diffuser 38 has a plurality of circumferentially spaced tapered sections or wedges 39 with tapered channels 41 therebetween. The compressed refrigerant then passes radially outwardly through the tapered channels 41 as shown.

Figure 6:
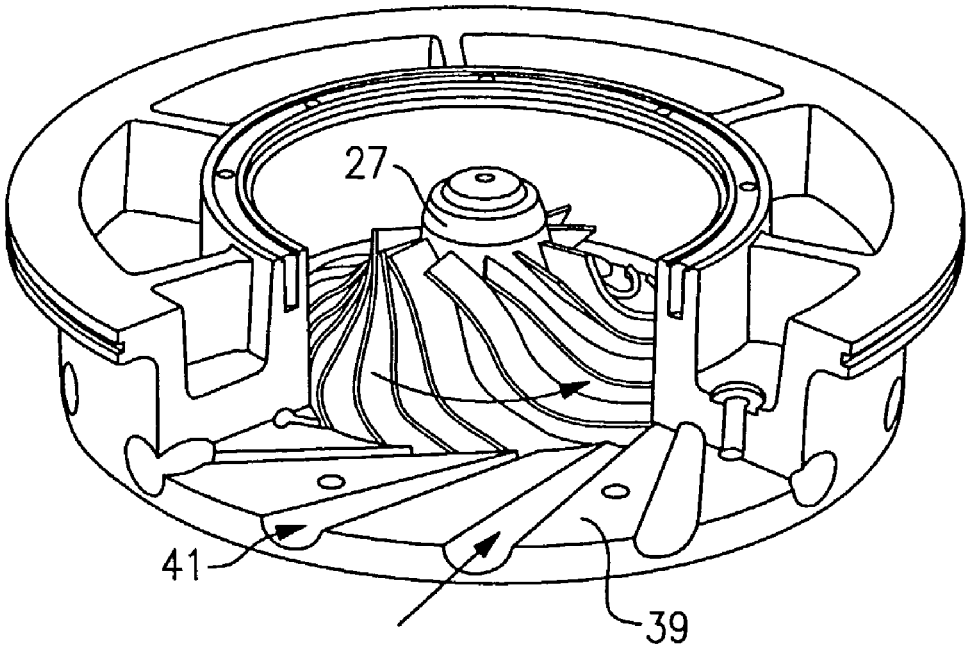
FIG. 6 is a schematic illustration of the nozzle structure in accordance with a preferred embodiment of the invention.

In the application wherein the centrifugal compressor is operated as a turbine as shown in FIG. 6, the impeller 27 rotates in a counterclockwise direction as shown, with the impeller 27 being driven by the motive fluid which flows radially inwardly through the tapered channels 41 as shown by the arrow.

Thus, the same structure which serves as a diffuser 38 in a centrifugal compressor is used as a nozzle, or collection of nozzles, in a turbine application. While such a nozzle arrangement offers advantages over prior art nozzle arrangements the performance thereof can be improved for particular operating conditions as will be more fully described hereinafter. To consider the differences and advantages over the prior art nozzle arrangements, reference is made to FIGS. 7A and 7B hereof.

Figure 7A:
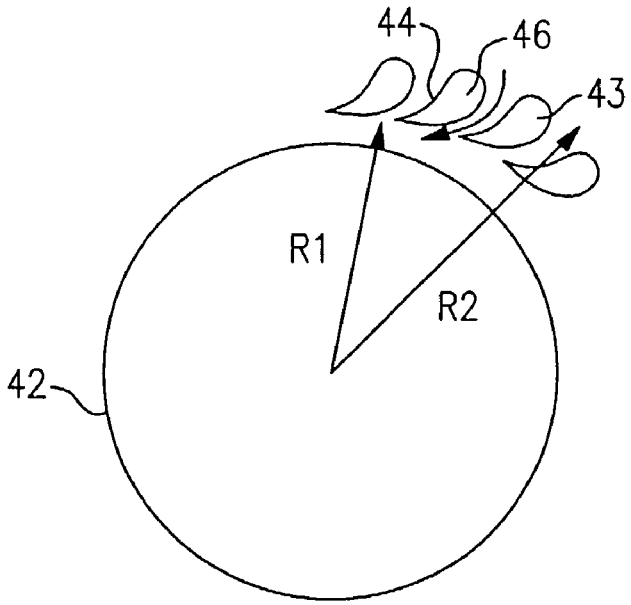
FIG.7A Prior Art
FIGS. 7A and 7B are schematic illustrations of $R_2/R_1$ (outside/inside) radius ratios for turbine nozzle arrangements for the prior art and for the present invention, respectively.

Referring now to FIG. 7A, a prior art nozzle arrangement is shown with respect to a centrally disposed impeller 42 which receives motive fluid from a plurality of circumferentially disposed nozzle elements 43. The radial extent of the nozzles 43 are defined by an inner radius $R_1$ and an outer radius $R_2$ as shown. It will be seen that the individual nozzle elements 43 are relatively short with quickly narrowing cross sectional areas from the outer radius $R_2$ to the inner radius $R_1$. Further, the nozzle elements are substantially curved both on their pressure surface 44 and their suction surface 46, thus causing a substantial turning of the gases flowing therethrough as shown by the arrow.

The advantage of the above described nozzle design is that the overall machine size is relatively small. Primarily for this reason, most, if not all, nozzle designs for turbine application are of this design. With this design, however, there are some disadvantages. For example, nozzle efficiency suffers from the nozzle turning losses and from exit flow non uniformities. These losses are recognized as being relatively small and generally well worth the gain that is obtained from the smaller size machine. Of course it will be recognized that this type of nozzle cannot be reversed so as to function as a diffuser with the reversal of the flow direction since the flow will separate as a result of the high turning rate and quick deceleration.

Figure 7B:
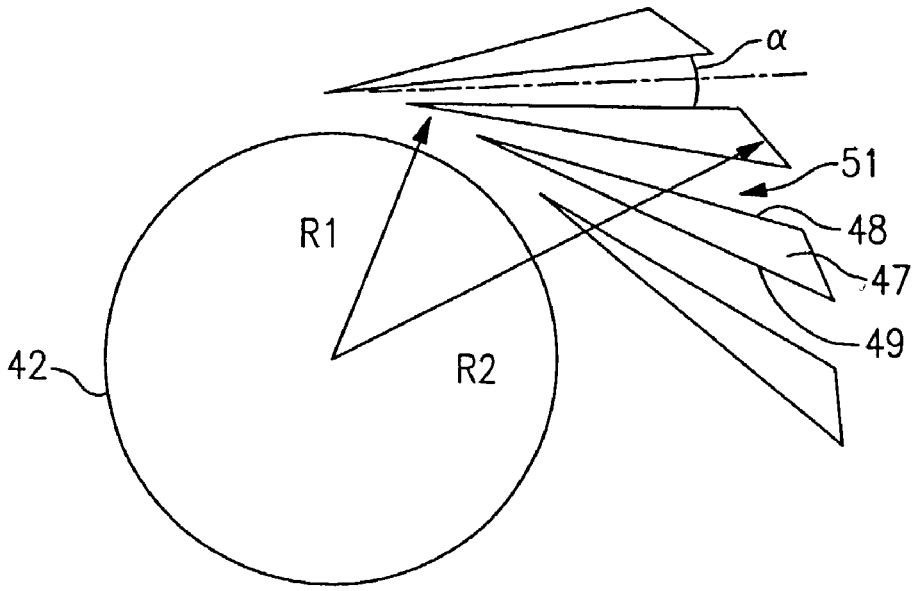

Referring now to FIG. 7B, the nozzle arrangement of the present invention is shown wherein the impeller 42 is circumferentially surrounded by a plurality of nozzle elements 47. It will be seen that the nozzle elements are generally long, narrow and straight. Both the pressure surface 48 and the suction surface 49 are linear to thereby provide relatively long and relatively slowly converging flow passage 51. They include a cone-angle within the boundaries of the passage 51 at preferably less then 9 degrees, and, as will been seen, the center line of these cones as shown by the dashed line, is straight. Because of the relatively long nozzle elements 47, the $R_2/R_1$ ratio is greater then 1.25 and preferably in the range of 1.4.

Because of the greater $R_2/R_1$ ratio, there is a modest increase in the overall machine size (i.e. in the range of 15%) over the conventional nozzle arrangement of FIG. 7A. Further, since the passages 51 are relatively long the friction losses are greater than those of the conventional nozzles of FIG. 7A. However there are also some performance advantages with this design. For example, since there are no turning losses or exit flow non-uniformities, the nozzle efficiency is substantially increased over the conventional nozzle arrangement even when considering the above mentioned friction losses. This efficiency improvement is in the range of 2%. Further, since this design is based on a diffuser design, it can be used in a reversed flow direction for applications as a diffuser such that the same hardware can be used for the dual purpose of both turbine and compressor as described above and as will be more fully described hereinafter.

Figure 8:
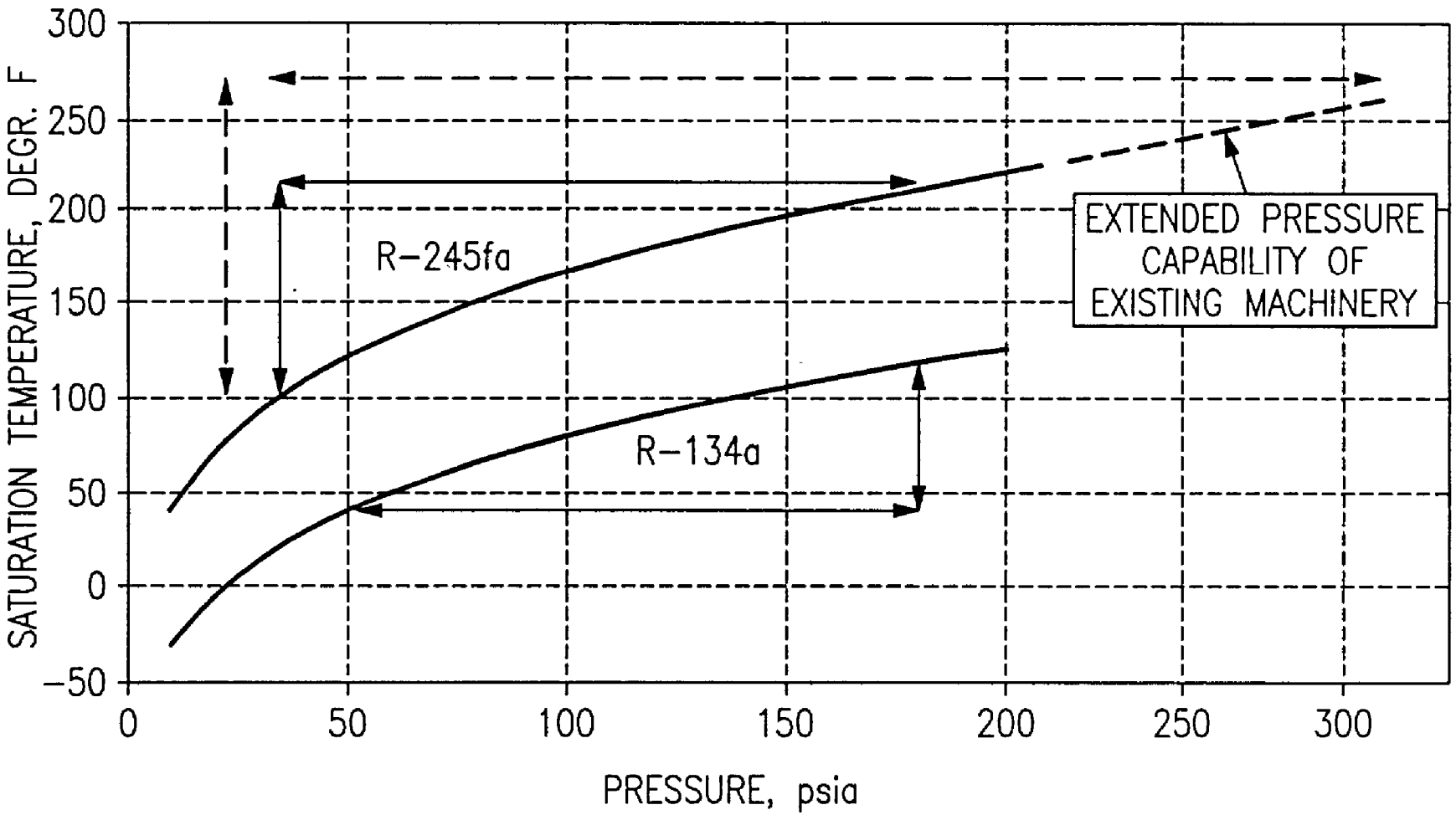
FIG. 8 is a graphical illustration of the temperature and pressure relationships of two motive fluids as used in the compressor/turbine in accordance with a preferred embodiment of the invention.

If the same apparatus is used for an organic rankine cycle turbine application as for a centrifugal compressor application, the applicants have recognized that a different refrigerant must be used. That is, if the known centrifugal compressor refrigerant R-134a is used in an organic rankine cycle turbine application, the pressure would become excessive. That is, in a centrifugal compressor using R-134a as a refrigerant, the pressure range will be between 50 and 180 psi, and if the same refrigerant is used in a turbine application as proposed in this invention, the pressure would rise to around 500 psi, which is above the maximum design pressure of the compressor. For this reason, it has been necessary for the applicants to find another refrigerant that can be used for purposes of turbine application. Applicants have therefore found that a refrigerant R-245fa, when applied to a turbine application, will operate in pressure ranges between 40-180 psi as shown in the graph of FIG. 8. This range is acceptable for use in hardware designed for centrifugal compressor applications. Further, the temperature range for such a turbine system using R-245fa is in the range of 100-200° F., which is acceptable for a hardware system designed for centrifugal compressor operation with temperatures in the range of 40-110° F. It will thus be seen in FIG. 8 that air conditioning equipment designed for R-134a can be used in organic rankine cycle power generation applications when using R-245fa. Further, it has been found that the same equipment can be safely and effectively used in higher temperatures and pressure ranges (e.g. 270° and 300 psia are shown by the dashed lines in FIG. 8) thanks to extra safety margins of the existing compressor.

Figure 9:
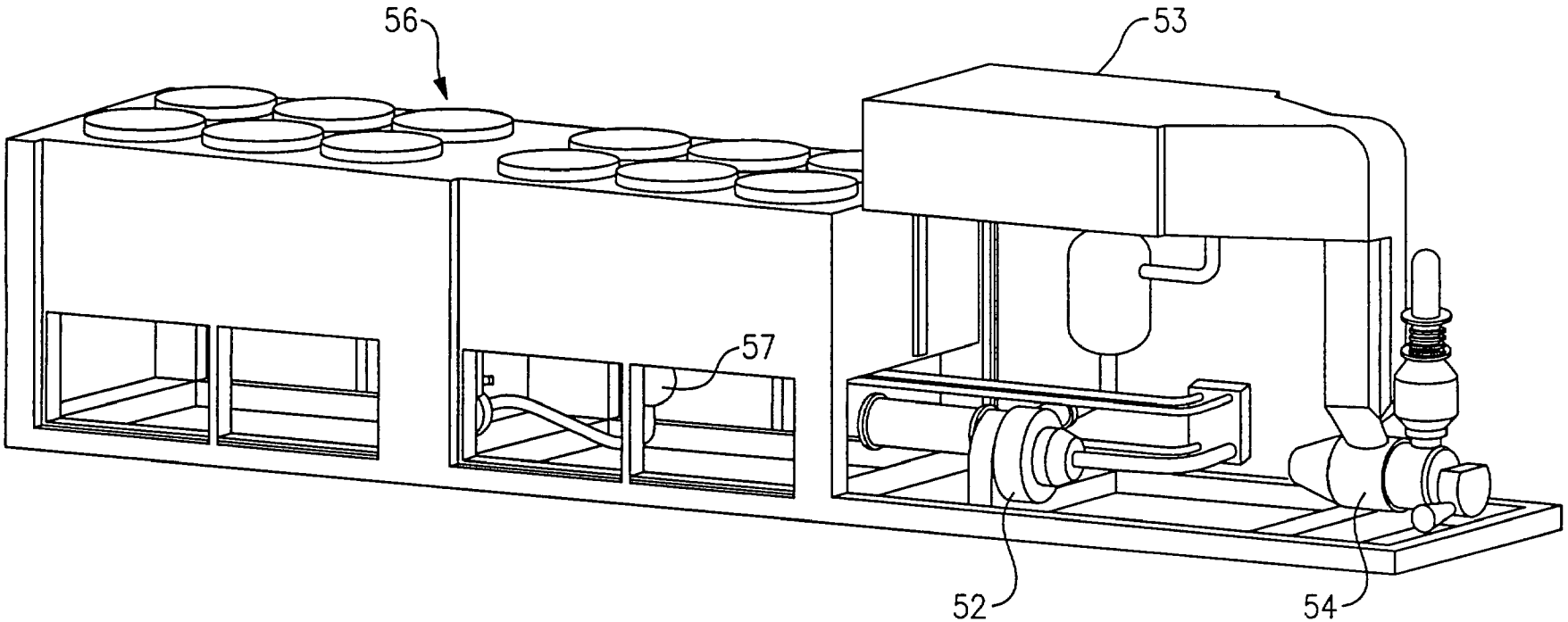
FIG. 9 is a perceptive view of a rankine cycle system with its various components in accordance with a preferred embodiment of the invention.

Having discussed the turbine portion of the present invention, we will now consider the related system components that would be used with the turbine. Referring to FIG. 9, the turbine which has been discussed hereinabove is shown at 52 as an ORC turbine/generator, which is commercially available as a Carrier 19XR2 centrifugal compressor which is operated in reverse as discussed hereinabove. The boiler or evaporator portion of the system is shown at 53 for providing relatively high pressure high temperature R-245fa refrigerant vapor to a turbine/generator 52. In accordance with one embodiment of the invention, the needs of such a boiler/evaporator may be provided by a commercially available vapor generator available from Carrier Limited Korea with the commercial name of 16JB.

The energy source for the boiler/evaporator 53 is shown at 54 and can be of any form of waste heat that may normally be lost to the atmosphere. For example, it may be a small gas turbine engine such as a Capstone C60, commonly known as a microturbine, with the heat being derived from the exhaust gases of the microturbine. It may also be a larger gas turbine engine such as a Pratt & Whitney FT8 stationary gas turbine. Another practical source of waste heat is from internal combustion engines such as large reciprocating diesel engines that are used to drive large generators and in the process develop a great deal of heat that is given off by way of exhaust gases and coolant liquids that are circulated within a radiator and/or a lubrication system. Further, energy may be derived from the heat exchanger used in the turbocharger intercooler wherein the incoming compressed combustion air is cooled to obtain better efficiency and larger capacity.

Finally, heat energy for the boiler may be derived from geothermal sources or from landfill flare exhausts. In these cases, the burning gases are applied directly to the boiler to produce refrigerant vapor or applied indirectly by first using those resource gases to drive an engine which, in turn, gives off heat which can be used as described hereinabove.

After the refrigerant vapor is passed through the turbine 52, it passes to the condenser 56 for purposes of condensing the vapor back to a liquid which is then pumped by way of a pump 57 to the boiler/evaporator 53. Condenser 56 may be of any of the well known types. One type that is found to be suitable for this application is the commercially available air cooled condenser available from Carrier Corporation as model number 09DK094. A suitable pump 57 has been found to be the commercially available as the Sundyne P2CZS.

Considering now how the equipment as described hereinabove can be most effectively applied to use the available energy from waste heat, it is recognized that the temperature ranges of the most common waste heat sources vary substantially. For example, the temperature of flares are most likely in the range of 1100° F., whereas the temperature of circulating fluids in a reciprocating engine is 300° F. and the exhaust temperature of a reciprocating engine is 700° F. In a gas turbine engine, the exhaust temperatures vary, depending on designs, from 400 to 750° F. If the same rankine cycle system is used for each of these applications, there will be substantial inefficiencies that result. Accordingly, it is desirable to modify the designs to accommodate the particular applications.

Figure 10:
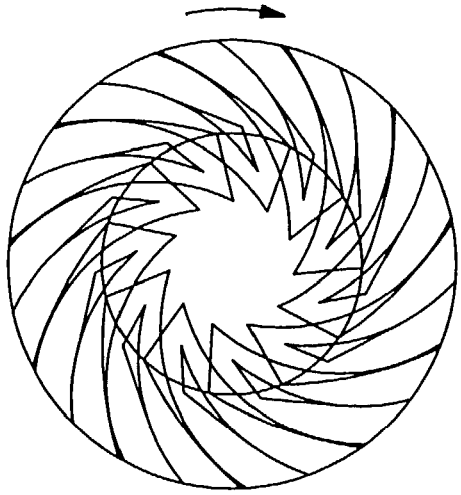
FIG. 10 is an axial view of one embodiment of the rotor of the compressor/turbine portion of the invention.

Referring now to Table 1 below, there are listed various applications for both centrifugal compressors and for organic rankine cycle turbines. These applications can best be characterized in accordance with pressure rations, wherein, for compressor applications, the pressure ratio $P_R$ equals $P_{Condenser}/P_{Evaporator}$ and for turbine application, the pressure ratio $P_R$ equals $P_{evaporator}/P_{Condenser}$. The applicants have therefore found that, for example, for a centrifugal compressor operating in moderate ambient conditions, a pressure ratio of 2:1 is desirable. If the same equipment is used in an organic rankine cycle turbine in such a relatively low lift application, the pressure ratio $P_R$ would be 4:1, and this can be most effectively and efficiently used when applying waste heat in relatively low temperature conditions such as $T_{gas}$<300° F. or $T_{steam}$<225° F. In each of these applications, the rotor or impeller is one having back swept blades as shown in FIG. 10. Thus, a single compressor/turbine machine with such a back swept impeller can be effectively interchanged within these two applications, thereby effectively and economically heat the needs thereof.

TABLE 1

| Compressor | Turbine |
|---|---|
| $P_R$ = 2:1 Moderate temperatures ($T_{cond,sat}$ − $T_{evap,sat}$) ≈ 55° F. | $P_R$ = 4:1. Low grade waste heat availability ($T_{gas}$ < 300 F. or $T_{steam}$ < 225 F. resulting in refrigerant boiling temperatures Trefr, boiling < 200 F.). |
| $P_R$ = 3:1 Tropical Climate ($T_{cond,sat}$ − $T_{evap,sat}$) ≈ 70° F. | $P_R$ = 6:1. Medium grade waste heat availability (300 < $T_{gas}$ < 500 F. or 225 < $T_{steam/water}$ < 300 F.) resulting in 200 F. < Trefr, boiling < 275). |
| $P_R$ = 4.5:1 Ice Storage/High Lift ($T_{cond,sat}$ − $T_{evap,sat}$) ≈ 80° F. | $P_R$ = 10:1. High grade waste heat availability ($T_{gas}$ > 500 F. or $T_{steam/water}$ > 300 F. resulting in Tref, boiling > 250. |

Figure 11:
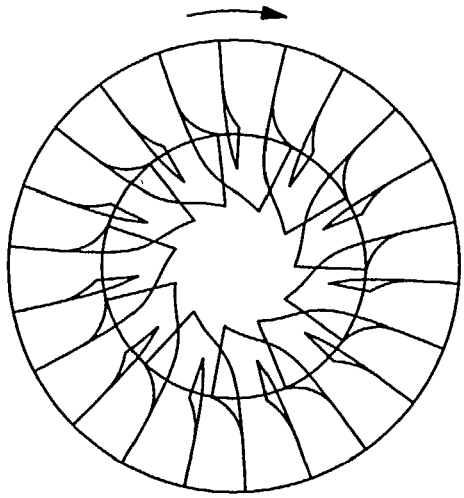
FIG. 11 is another embodiment thereof.

Generally, referring to the tropical climate application of a centrifugal compressor chiller and/or a medium grade waste heat application of a turbine, the applicants have found that an impeller having radially aligned blade as shown in FIG. 11 can be most effectively and economically used in these applications.

Figure 12:
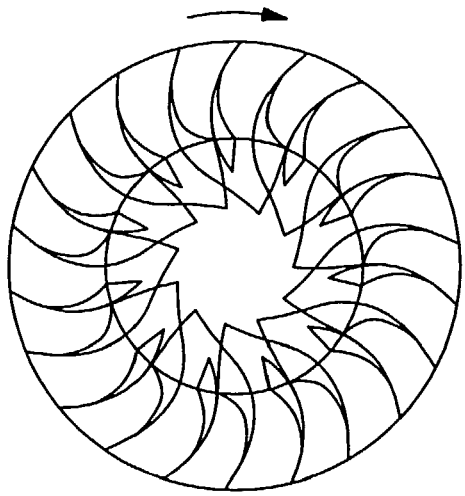
FIG. 12 is yet another embodiment thereof.

Finally, for centrifugal compressor applications for purposes of ice storage/high lift, and high grade waste heat turbine applications, a forward swept turbine as shown in FIG. 12 is preferably used with compressor pressure ratios of 4.5:1 and turbine pressure ratios of 10:1 resulting.

Other factors may come into play to vary the above described applications. For example, if the heat rejection (condenser) is water cooled instead of air-cooled the available lift/pressure ratio for the turbine increases (water cooling allows a lower condenser saturation temperature and therefore a lower condenser saturation pressure thus increasing the pressure ratio of boiling pressure/condensing pressure). As a result, medium grade waste heat might require a forward curved impeller.

I claim:

1. A method of constructing a turbine for use in a rankine cycle system having in serial flow relationship a pump, a boiler, a turbine and a condenser, comprising the steps of:

providing a volute for receiving a vapor medium from the evaporator and for conducting said vapor radially inwardly;

providing a plurality of nozzles circumferentially spaced and disposed around the inner periphery of said valuate for receiving a flow of vapor therefrom and conducting it radially inwardly; and providing an impeller disposed radially within said nozzles such that the radial inflow of vapor from said nozzles impinges on a plurality of circumferentially spaced blades of said impeller to cause rotation of said impeller; wherein, the angle of said impeller blades is chosen according to the degree of lift for the intended application, such that for relatively low-lift application, the impeller blades are back swept, for intermediate-lift applications, the blades are radially disposed, and for relatively high-lift applications, the impeller blades are forward swept.

2. A method as set forth in claim 1 wherein said diffuser is a vaned diffuser.

3. A method as set forth in claim 2 wherein said diffuser is a pipe diffuser.

4. A method as set forth in claim 1 wherein said vapor is an organic refrigerant.

5. A method as set forth in claim 4 wherein said vapor is R-245fa.

6. A method as set forth in claim 1 wherein each of said plurality of nozzles has its radially inner and outer boundaries defined by $R_1$ and $R_2$, respectively, and wherein $R_2/R_1$>1.25.

7. An organic rankine cycle system of the type having in serial flow relationship a pump, an evaporator, a turbine and a condenser, wherein said turbine comprises:

an arcuately disposed volute for receiving an organic refrigerant vapor medium from the evaporator and for conducting the flow of said vapor radially inwardly;

a plurality of nozzles circumferentially spaced and disposed around the inner periphery of said volute for receiving a flow of vapor therefrom and conducting it radially inwardly; and an impeller disposed radially within said nozzles such that the radial inflow of vapor from said nozzles impinges on the plurality of circumferentially spaced blades on said impeller to cause rotation of said impeller; and discharge flow means for conducting the flow of vapor from said turbine to the condenser;

wherein, said impeller blades are either back swept or forward swept and further wherein each of said nozzles has its radially inner and outer boundaries defined by radii $R_1$ and $R_2$, respectively, and wherein $R_2/R_1$>1.25.

8. An organic rankine cycle system as set forth in claim 7 wherein the application is for a relatively low lift application and further wherein said impeller blades are back swept.

9. An organic rankine cycle system as set forth in claim 7 wherein the application is for a relatively high lift application and further wherein said impeller blades are forward swept.

10. An organic rankine cycle system as set forth in claim 7 wherein said plurality of nozzles are of the vane type.

11. An organic rankine cycle system as set forth in claim 10 wherein said nozzles are each comprised of a frustroconical passageway.

12. An organic rankine cycle system as set forth in claim 7 wherein the pressure of a vapor entering said volute is in the range of 180-330 psia.

13. An organic rankine cycle system as set forth in claim 7 wherein the saturation temperature of the vapor entering the volute is in the range of 210-270□F.

14. An organic rankine cycle system as set forth in claim 7 wherein the evaporator receives heat from an internal combustion engine.

15. An organic rankine cycle system as set forth in claim 14 wherein the heat derived from said internal combustion engine is derived from the exhaust thereof.

16. An organic rankine cycle system as set forth in claim 15 wherein the heat derived from said internal combustion engine is derived from its liquid coolant being circulated within said internal combustion engine.

17. An organic rankine cycle system as set forth in claim 7 wherein. said condenser is of the water cooled type.

18. An organic rankine cycle system as set forth in claim 7 wherein said organic refrigerant is R-245fa.

* * * * *